United States Patent [19]

Chitose et al.

[11] Patent Number: 4,457,792

[45] Date of Patent: Jul. 3, 1984

[54] METHOD OF MANUFACTURING A MOLDED COIL

[75] Inventors: Takashi Chitose; Teruo Ina, both of Hyogo, Japan

[73] Assignee: Mitsubishi Denki Kabushiki Kaisha, Tokyo, Japan

[21] Appl. No.: 545,582

[22] Filed: Oct. 25, 1982

Related U.S. Application Data

[63] Continuation of Ser. No. 319,756, Nov. 9, 1981, abandoned.

[30] Foreign Application Priority Data

Nov. 12, 1980 [JP] Japan ..... 55-159981

[51] Int. Cl.[3] ..... H01B 13/08; H01F 5/06

[52] U.S. Cl. ..... 156/56; 29/605; 156/48; 156/53; 156/188; 156/242; 242/7.08; 336/15; 336/222

[58] Field of Search ..... 29/605, 606, 609; 156/48, 52, 53, 56, 184, 188, 242; 242/7.08; 336/15, 222; 428/178

[56] References Cited

U.S. PATENT DOCUMENTS 3,393,268 7/1968 Meyer et al. ..... 156/56 X 4,268,810 5/1981 Iwasa et al. ..... 29/605 X

*Primary Examiner*—Robert A. Dawson

*Attorney, Agent, or Firm*—Sughrue, Mion, Zinn, Macpeak and Seas

[57] ABSTRACT

A method of manufacturing a molded coil for use in an electric apparatus such as a molded transformer or a reactor. The method includes the steps of covering a winding with an insulating prepreg, curing the prepreg under heat, and casting a synthetic resin around the prepreg. The method makes it possible to minimize any thermal stress that may develop in the molded resin layer.

4 Claims, 3 Drawing Figures

METHOD OF MANUFACTURING A MOLDED COIL

This application is a continuation of application Ser. No. 319,756, filed Nov. 9, 1981, now abandoned.

BACKGROUND OF THE INVENTION

1. Field of the Invention

This invention relates to a method of manufacturing a molded coil for use in an electric apparatus, such as a molded transformer or a reactor.

2. Description of the Prior Art

The casting resin and the internal conductor in a molded coil expand and contract to some extent in accordance with their respective coefficients of thermal expansion as a result of the generation of heat during operation, or the variation in ambient temperature during the interruption of operation. As the casting resin and the internal conductor are joined to each other, the difference in their coefficients of thermal expansion results in development of thermal stress in the resin layer. This thermal stress may be expressed by equation (1), as is generally known:

$$\sigma = Er \cdot (\alpha_r - \alpha_c) \cdot \Delta T \quad (1)$$

in which $\sigma$ stands for the thermal stress, $E_r$ stands for the Young's modulus of the casting resin, $\alpha_r$ and $\alpha_c$ stand for the coefficient of thermal expansion of the casting resin and the internal conductor, respectively, and $\Delta T$ stands for the temperature difference. If the thermal stress exceeds the tensile strength of the resin layer, the resin layer is likely to crack. If the resin layer has cracked, the cracked portion develops a corona discharge, and absorbs moisture, resulting in an unavoidable reduction in the insulation performance of the resin layer.

In order to lower the thermal stress, therefore, it has been proposed to reduce the difference between the coefficients of thermal expansion of the casting resin and the conductor ($\alpha_r - \alpha_c$). For example, it has been found effective to use an aluminum conductor instead of a copper one. The casting resin, aluminum and copper have a coefficient of thermal expansion of 31.0 $\mu$/°C., 23.0 $\mu$/°C. and 16.6 $\mu$/°C., respectively. The difference in coefficient of thermal expansion is 8.0 $\mu$/°C. in case an aluminum conductor is used, while it is 14.4 $\mu$/°C. in the case of a copper conductor. The use of an aluminum conductor can reduce the thermal stress in the resin layer to about a half of that which develops in the event a copper conductor is used.

The aluminum conductor is, however, lower in conductivity than the copper one. It is necessary to lower the current density of a winding extremely, and the coil requires an increased volume, and a greater amount of resin. Moreover, the use of aluminum does not mean the elimination of the thermal stress on the resin layer; there is still every likelihood that the resin layer may crack.

SUMMARY OF THE INVENTION

It is an object of this invention to provide a method of manufacturing a molded coil which is free from any drawback of the prior art as hereinabove pointed out. The method of this invention essentially comprises covering a winding with an insulating prepreg, curing the prepreg under heat, and casting a synthetic resin around the prepreg. The method makes it possible to minimize any thermal stress that may develop in the molded resin layer.

DETAILED DESCRIPTION OF THE INVENTION

Figure 1:
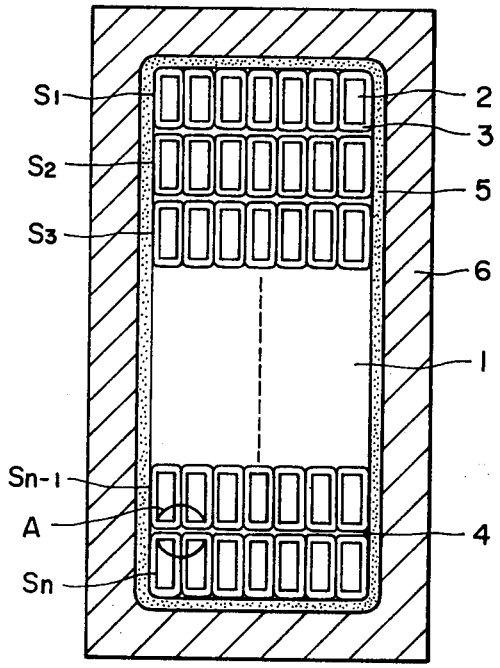
FIG. 1 is a longitudinal sectional view of a molded coil embodying this invention.
Figure 2:
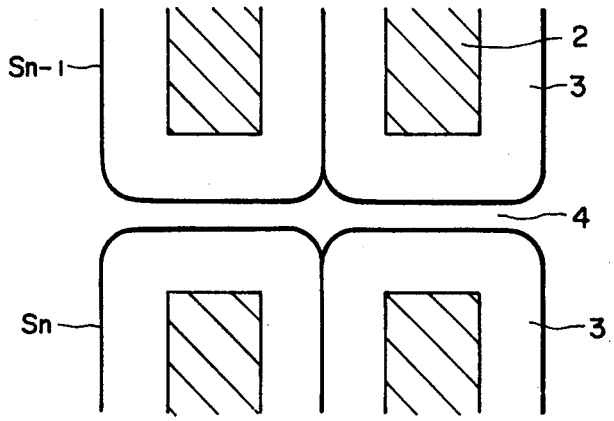
FIG. 2 is a detailed view of portion 'A' in FIG. 1.

Referring first to FIG. 1 of the drawings, a molded coil obtained according to the method of this invention includes a winding 1 which comprises an axially stacked array of disk-shaped layers $S_1$, $S_2$, . . . $S_n$ of a conductor wire wound in a predetermined number of turns. There is a very small clearance 4 between every two adjoining conductor layers $S_1$ and $S_2$, $S_2$ and $S_3$, . . . or $S_{n-1}$ and $S_n$. A prepreg resin layer 5, or a layer of a semicured synthetic resin covers the inner and outer peripheral surfaces, and upper and lower end surfaces of the winding 1. The prepreg layer 5 is covered with a layer of casting resin 6 cast around the winding 1 after the prepreg 5 has been cured.

The molded coil of this invention as hereinabove described may be manufactured as will hereinafter be set forth. An internal conductor 2 is covered with an insulating tape 3. The insulating tape 3 may, for example, comprise a synthetic resin film, heat resistant paper such as of polyamide, or a prepreg film. The conductor 2 thus insulated is wound in a predetermined number of turns, and formed into a plurality of axially stacked conductor layers $S_1$, $S_2$, . . . and $S_n$. There is inevitably formed a very small clearance 4 having a width of, say, 0.05 to 0.1 mm between every two adjoining conductor layers. This clearance may be adjusted in accordance with the degree to which the winding is tightened after it has been fully wound. It is, however, necessary to ensure that the clearance 4 should have a sufficient width to absorb any difference in thermal expansion or contraction between the resin layer and the internal conductor as expressed in equation (1) as $(\alpha_r - \alpha_c) \cdot \Delta T$. If, for example, the conductor 2 is a copper wire, there is a temperature difference of 130° C., and the coil has a height of 1 m, such difference in thermal expansion or contraction amounts to about 1.9 mm $[(31.0-16.6) \cdot 130 \cdot 10^{-6} \cdot 1000]$. If the number n of the conductor layers $S_1$ to $S_n$ is 50, the clearance 4 may have a width of, say, 0.04 mm.

The winding 1 is, then, covered on its inner and outer peripheral, and upper and lower end surfaces with a sheet or tape of a prepreg resin 5. It is, then, heated in an oven until the prepreg resin 5 is completely cured. Then, a casting resin 6 is cast around the winding 1, whereby a molded coil is obtained. The clearances 4 in the winding 1 are not filled with the casting resin, but remain open, since they are covered with a fully cured layer of prepreg resin 5. The clearances 4 can absorb any thermal stress that may develop in the casting resin as a result of the generation of heat during operation, or any variation in ambient temperature during the interruption of operation. If the width of the clearances 4 is appropriately selected, it is possible to minimize any such thermal stress even if the conductor 2 is composed of copper, or any other material having a coefficient of thermal expansion which is largely different from that of the casting resin 6.

Figure 3:
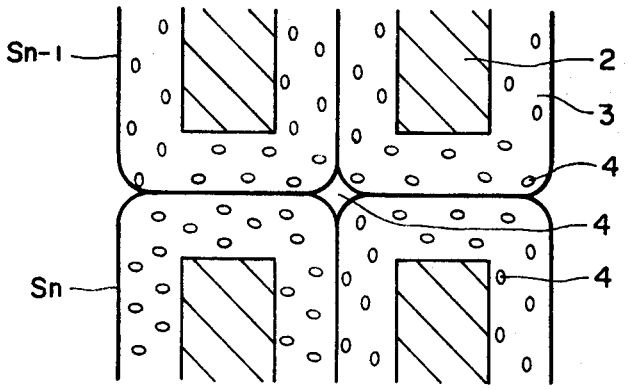
FIG. 3 is a view similar to FIG. 2, but showing another embodiment of this invention in which a prepreg tape is used for insulating a wire.

FIG. 3 shows a different embodiment of this invention in which the conductor 2 is covered with a prepreg tape 3 in which the clearances 4 exist.

According to this invention, it is possible to minimize any thermal stress that may develop in the casting resin, whichever material the conductor may comprise. It is possible to use a copper conductor, and raise its current density to thereby obtain a molded coil having a small volume, and which requires only a small amount of resin. The molded coil of this invention is by far more resistant to cracking than any known molded coil.

What is claimed is:

1. A method of manufacturing a molded coil including a winding having adjacent contuctor portions with gaps therebetween, said method comprising:

covering said winding with a prepreg resin while preserving said gaps between said adjacent conductor portions;

heating said prepreg resin for curing it to thereby form a protective cover which will prevent casting resin from filling in said gaps whereby said gaps will permit thermal expansion of said conductor portions within said protective cover; and casting a casting resin around said prepreg resin.

2. A method of manufacturing a molded coil, which comprises;

covering a conductor with an insulating tape;

winding said conductor to form a winding which comprises an axially stacked array of disk-shaped conductor layers, said winding having therein a clearance which provides allowance for thermal expansion;

covering said winding with a prepeg resin while preserving said clearance;

heating said prepreg resin for curing it to thereby form a protective cover which will prevent casting resin from filling in said clearance whereby said clearance will permit thermal expansion of said winding conductor within said cover; and casting a casting resin around said prepreg resin.

3. A method as set forth in claim 2, wherein said clearance is formed between every adjoining two of said conductor layers.

4. A method as set forth in claim 2, wherein said insulating tape comprises a prepreg resin, and wherein said clearance is formed in said insulating tape.

* * * * *